250-506.1 SR

OR 3,982,134

United S

Housholder e

[11] 3,982,134

[45] Sept. 21, 1976

[54] SHIPPING CONTAINER FOR NUCLEAR FUELS

[76] Inventors: William R. Housholder, 807 Mullins St., Johnson City, Tenn. 37601; Norman L. Greer, 1409 Central Ave., Elizabethton, Tenn. 37643

[22] Filed: Sept. 19, 1974

[21] Appl. No.: 507,588

Related U.S. Application Data

[63] Continuation-in-part of Ser. No. 447,320, March 1, 1974, abandoned.

[52] U.S. Cl. ..... 250/506; 250/515

[51] Int. Cl.[2] ..... G21F 1/00

[58] Field of Search ..... 250/428, 432, 496, 506, 250/507, 515

[56] References Cited

UNITED STATES PATENTS

| | | | |
|---|---|---|---|
| 3,230,373 | 1/1966 | Montgomery | 250/506 X |
| 3,432,666 | 3/1969 | Nash et al. | 250/506 |
| 3,466,662 | 9/1969 | Blum | 250/506 |
| 3,600,586 | 8/1971 | Barthelemy et al. | 250/496 X |
| 3,727,060 | 4/1973 | Blum | 250/506 |
| 3,749,917 | 7/1973 | Kucherer | 250/506 X |

*Primary Examiner*—Archie R. Borchelt

[57] ABSTRACT

A container for nuclear materials wherein a specially and uniquely constructed pressure vessel and gamma shield assembly for holding the nuclear materials is provided in a housing, and wherein a positioning means extends between the housing and the assembly for spacing the same, insulation in the housing essentially filling the space between the assembly and housing, the insulation comprising beads, globules or the like of water encapsulated in plastic and which, in one important embodiment, contains neutron absorbing matter.

23 Claims, 6 Drawing Figures

SHIPPING CONTAINER FOR NUCLEAR FUELS

This application is a continuation-in-part of our copending application Ser. No. 447,320, filed Mar. 1, 1974, titled "Shipping Container For Nuclear Fuels," and now abandoned.

This invention relates to containers for radioactive materials, particularly for nuclear fuels, and is directed to the special structure and composition thereof.

Nuclear fuel containers are necessarily of very special construction involving considerations of gas and liquid seals, pressure and temperature build-up, physical dimensions as regards neutron flux, and enormous physical and heat strength demanded by the A.E.C. prescribed drop and oil fire tests, while maintaining container weight at a realistic level.

The present invention represents very advanced improvements in container design and composition and in one of its broad embodiments can be defined as comprising a metal housing, a pressure vessel and gamma shield assembly in said housing, positioning means extending between said housing and said assembly for spacing the same, and insulation essentially filling the space between said assembly and housing and comprising water beads encapsulated in plastic.

This novel basic system allows the use of the more complicated structure and composition which is detailed below in the specification and drawings wherein certain dimensions are shown out of proportion for purposes of clarity.

Figure 2:
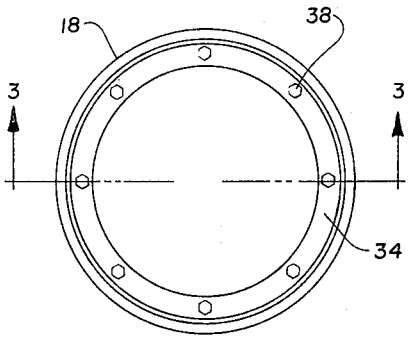
FIG. 2 is a top view thereof.
Figure 1:
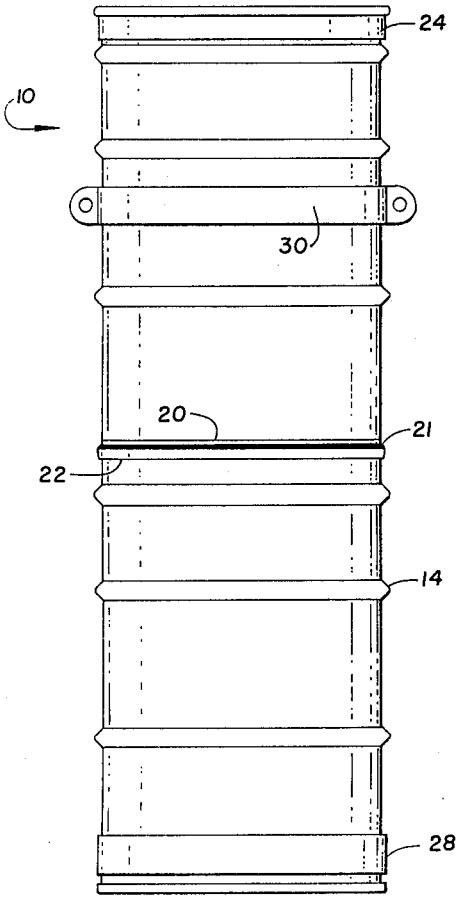
FIG. 1 is a side elevation of the container.
Figure 3:
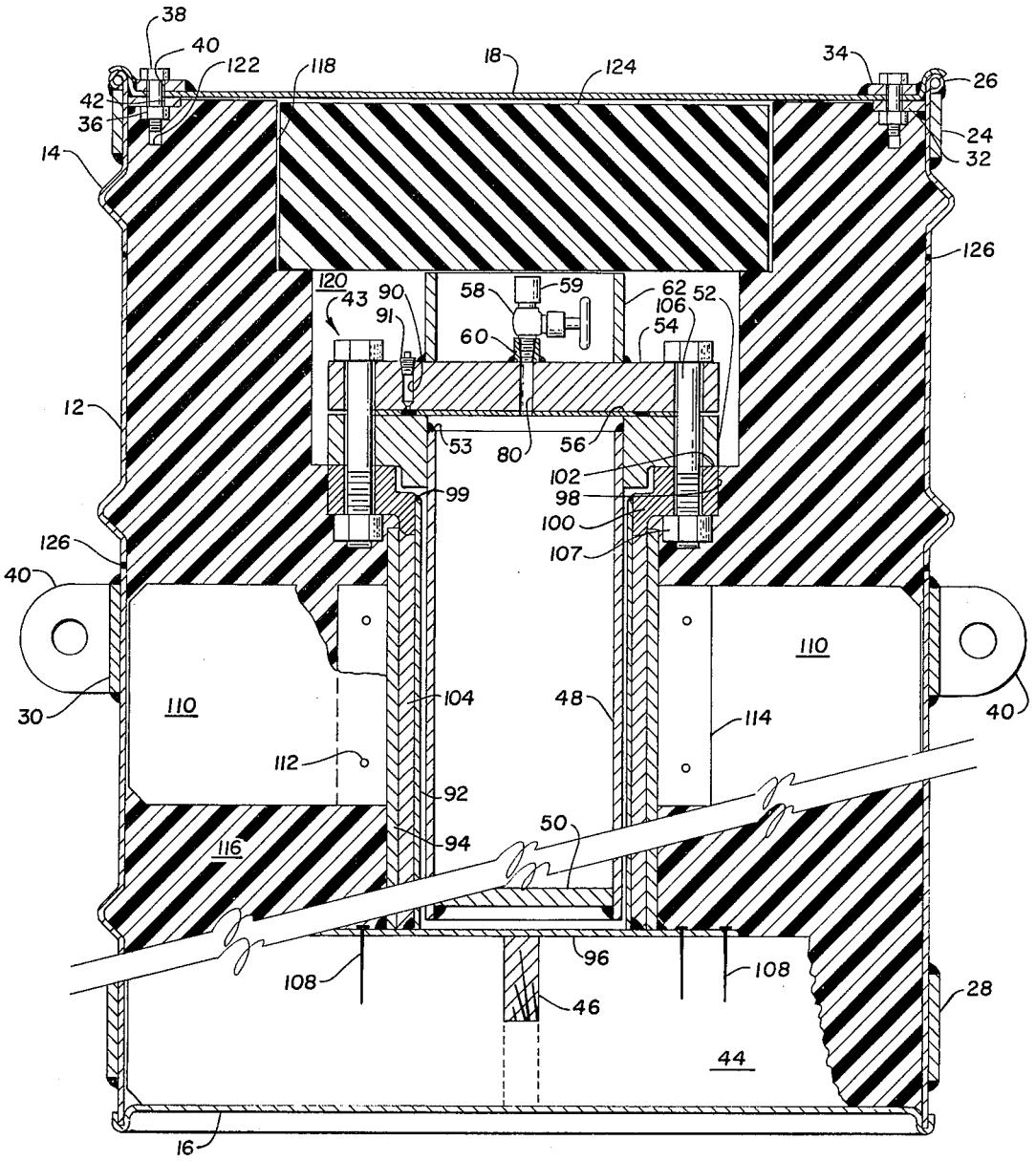
FIG. 3 is a cross-sectional view taken along line 3—3 of FIG. 2.

Referring to FIGS. 1–3, the container generally designated 10 comprises a metal housing 12 in the general form of an elongated cylinder having formed strengthening ribs 14, bottom 16, and cover 18. This housing may be constructed conveniently from two 16 gauge steel 55-gallon drums with the bottom of the top drum cut out and the remaining flange 20 welded as at 21 to the curled rim 22 of the top of the lower drum.

A first bar band 24 is welded to the top of housing 12 just below curled rim 26, a second bar band 28 is welded to the housing near the bottom thereof, and a third bar band 30 is welded to the housing about one-fourth of the way down the housing. These bands are preferably of ¼-inch thick steel, 1¾-inches wide at 24, and 3-inches wide at 28 and 30. A bar ring 32, designated herein as second bar ring for purposes of claim clarity, preferably ¼-inch by 1½-inch steel rolled edgewise, is welded to the inside of housing 12 at a position which allows the cover 18 to snugly fit. Preferably, the weld of ring 32 penetrates through housing 12 into first bar band 24 to provide a very strong unitary structure. A first bar ring 34, preferably ¼-inch by 1½-inch steel rolled edgewise, is welded to the upper surface of cover 18. Nuts 36 are attached, preferably by tack welding, to the underside of ring 32 to receive bolts 38 inserted through mating apertures 40 and 42 in rings 34 and 32, respectively. A pair of lifting lugs 40, preferably ¼-inch by 3-inches flat bar steel are welded to band 30. In the construction of the present container, all stainless steel welds should be by Tungsten Inert Gas Process (TIG) and all carbon steel welds should be by TIG, Metal Inert Gas or shielded arc.

The pressure vessel and gamma shield assembly generally designated 43 is preferably mounted on and spaced from the bottom 16 of the housing by a wooden cross of two pieces 44 and 46 of 2-inch by 4¾-inch white oak. Piece 44 is broken away at one end to show that the insulation later described in detail extends to the bottom of the container. Assembly 43 comprises the pressure vessel consisting of tube 48, preferably 5-inch Schedule (Sch.) 40, 304L stainless steel (SS) pipe, welded closed at the bottom 50, preferably by ½-inch by 5-inch diameter 304L SS., first flange 52, preferably 5-inch - 300 pound Slip-on Flange 304L SS., welded to the top of tube 48 at 53, closure head 54, preferably 5-inch - 300 pound Blind Pipe Flange 304L SS., and a seal generally designated 56, shown in detail in FIG. 4.

Head 54 is provided with a gas relief valve 58, preferably a ¼-inch NPT Hoke Valve 316 SS. with ¼-inch NPT Pipe Cap 59, 304 SS., mounted in coupling 60, preferably a ¼-inch NPT 300 pound Half Coupling, 304L SS. welded to head 54. A shroud 62, preferably 5-inch Sch. 40 by 2½-inch pipe, 304L SS., welded to 54 protects Valve 58. This valve provides a controlled release of any gas which may be produced from the nuclear materials contained in the conventional vented polyethylene tube carried within tube 48.

Figure 5:
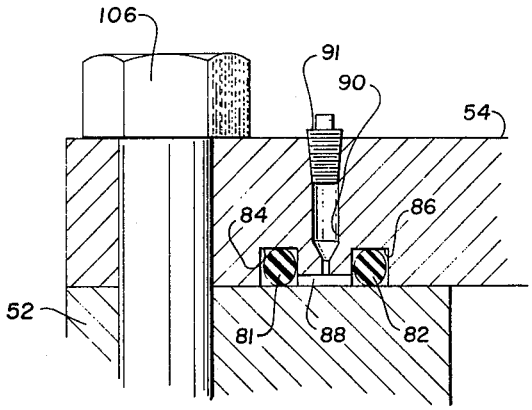
FIG. 5 is an enlarged cross-sectional view of a variation of the seal of FIG. 4.
Figure 4:
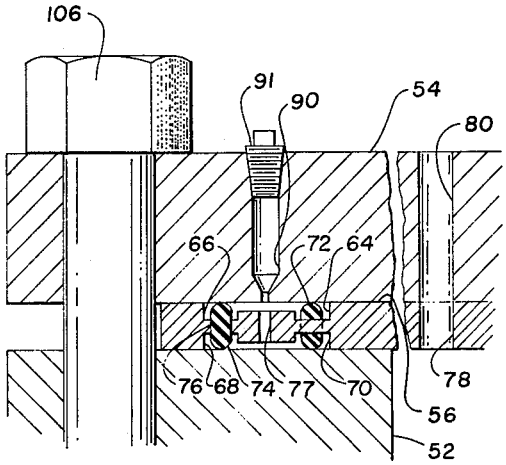
FIG. 4 is an enlarged cross-sectional view of the seal of FIG. 3.

The seal 56 is shown disproportionately large in FIG. 4 for purposes of clarity and in the preferred embodiment comprises a metal disc of about 11 gauge having two pairs of concentric channels 64 and 66, and 68 and 70 in which elastomeric rings 72 and 74 are positioned. These rings are preferably molded into the channels and retained therein by connecting webs 76 which are molded in and extend through suitably circumferentially spaced apertures in the disc joining the adjacent channels in opposite sides of the disc. The rings are of a temperature and chemical resistant material such as Viton A of duPont, a copolymer of hexafluoropropylene and vinylidene fluoride. A plurality of passageways 77 are provided through the disc so that each side of the seal may be pressure tested. An aperture 78 in the metal disc connects to the passageway 80 in head 54 communicating with valve 58. In FIG. 5, the seal is modified whereby the separate metal disc is eliminated and two elastomeric rings 80 and 82 nest in channels 84 and 86, respectively, cut into head 54. A plurality of conduits 88 or their equivalent connect the sealing rings for pressure testing.

The structure of seal 56 allows a seal test device such as a gas source and pressure change detector to be connected to port 90 to test the sealing of the pressure vessel at any time. Port 90 normally is sealed by a 304 SS. pipe plug 91.

The gamma shield as shown in FIG. 3 comprises inner wall 92, preferably of about 11 gauge steel tubing, outer wall 94, preferably of about ¼-inch steel tubing, bottom plate 96, preferably of about 11 gauge steel welded to adjacent ends of said walls, a second flange 98, preferably lap joint forged steel, welded to the periphery 99 of the open end of inner wall 92 and having a leg 100 projecting substantially normally downwardly from the face 102 of flange 98 a distance between walls 92 and 94, and a lead shield 104 about ½-inch thick poured into and essentially filling the space between said walls. Bolts 106, preferably cadmium plated, and nuts 107 tack welded to flange 98 clamp the assembly together.

It is particularly noted that leg 100 of flange 98 is not welded to wall 94 and allows thereby sufficient cocking or tipping motion of the pressure vessel and flanges to alleviate undue stress on bolts 106. This is quite important where the container is dropped or positioned on its side.

The above assembly may be secured to the wooden end spacer beams 44 and 46 by concrete nails 108. Similarly, wooden spacers 110, preferably four, equally spaced around the outer wall 94 of about 2-inch by 6-inch white oak are nailed at 112 to brackets 114 welded to wall 94.

A very important feature of the present invention resides in the insulation or neutron shield material generally designated 116 which fills substantially the remaining interior of the housing. This material is a water-in-resin emulsion type system which is poured into the housing and peroxide cured or cross-linked. A suitable mold is used to form the resin during cure to provide cavities 118 and 120 and bolt clearances 122. A separately formed and removable block 124 of this resin provides insulation at the top of the container while giving easy access to the pressure vessel. A plurality of pressure relief holes 126 of about 3/16-inch in diameter are formed through the housing at suitable positions throughout its surface and are plugged with a plastic cement, preferably epoxy. The function of these holes will become more apparent hereinafter.

This insulation is extremely important to the present invention in forming a combination spacer, positioner, heat barrier, concussion cushion and neutron shield for the pressure vessel (and polyethylene radioactive salt solution container or oxide container carried therein) and gamma shield assembly.

This particular form of insulation, which decomposes under high temperatures to form steam and gaseous products such as CO and $CO_2$, serves many functions and is quite unique in this application. For example, the hydrogen entrained in the water is a principal neutron absorber. The heat transfer characteristics of the insulation are such that, under normal conditions, the heat generated by radioactive decay of plutonium, uranium, americium, and other daughter and residue fission products is effectively emitted from the container, while, under abnormal conditions wherein, for example, extreme heat from an oil fire impinges on the housing exterior, such heat is not transferred to the pressure vessel and gamma shield assembly and its contents. In other words, under normal conditions, the heat transfer coefficient of the solid, non-porous insulation is just right for transferring the heat from radioactive decay out of the vessel, but when the container is subjected to oil fire heat, for example, the heat transfer coefficient is not such that destructive heat will transfer in. During such an oil fire, the heat barrier characteristics of the insulation come into play and the steam blanket limits the surface temperature, that is, the temperature of the interface between the housing and the insulation. In other words, decomposition of the insulation serves to impose automatically a maximum temperature differential between the housing and the gamma shield. The insulation also acts as a large heat sink and this large mass of insulation provides adequate water for the steam blanket to exist for the extended oil fire test.

The composition and preparation of the water extended resin may be varied. U.S. Pat. No. 3,256,219 (Reissue U.S. Pat. No. Re 27,444) describes various types of systems wherein the resin is made, for example, by polymerizing methyl methacrylate in the presence of polystyrene acting as emulsifier.

Another and preferred system, such as is shown in Example 11 of said patent, is that obtained, for example, from maleic acid reacted with a propylene glycol starting with maleic anhydride and under conditions well known to the art of "cooking" polyester resins to finally obtain an unsaturated resin of a molecular weight of from about 1200 to about 5,000 and having an acid number of from about 10 to about 100 or higher. This resin is then dissolved in a suitable monomer such as styrene to give a final polymerizable resinous system composed of from about 30–70% by weight polyester and conversely from about 70–30% by weight styrene. This system is readily polymerized by free radical polymerization initiators such as a large variety of peroxides, transition metal ions, and/or light and if long storage of the unpolymerized resin is desirable, such stabilizers as hydroquinone, the monomethylether of hydroquinone, or methylene blue may be added in about 50 – 200 ppm. A large variety of peroxide decomposition promoters such as the cobalt organic salts may be used in concert with the peroxides. The system is placed, preferably, in a mixer such as a Hobart dough mixer and the other components, preferably premixed, are slowly fed thereto to give mix compositions such as the following, expressed in weight percent:

40 polymerizable resinous system
24.3 water
25.9 ethylene glycol (antifreeze)
1.0 hydrogen peroxide
8.8 sodium tetraborate (neutron absorber)

This mix composition is maintained during mixing, preferably, at a temperature of from about 80° to about 105°F. for a short time (1–2 minutes may be adequate) to form an emulsion or gel which is then poured into the container housing and allowed to cure. In some instances, it may be desirable to add minor amounts of surfactants including those classed as detergents, protective colloids, and wetting agents. These may be from the categories of anionic, cationic, nonionic, or amphoteric surfactants.

In the above exemplary mix compositions, a particularly effective polymerizable resinous system is prepared from, in parts by weight, about 18–22 isophthalic acid, 3–8 maleic anhydride, 45–55 styrene, 3–8 propylene glycol, and 10–20 diethylene glycol. The well-known peroxide decomposition promoters such as cobalt neodecanate and dimethyl aniline may be premixed with this resinous system.

It has been found that the weight of the present container may be minimized by employing a filled version of the above composition in certain portions of the container. For example, it has been found that the resin will cure properly and retain the water in the presence of up to about 50% by weight, 15 to about 30% by weight being preferred, and about 20–30% by weight being most preferred, based on total insulation weight of vermiculite homogeneously blended into the emulsion or gel. Such filled insulation can be used in the lower portion of the container, that is, below about the bottom of bolts 106.

As indicated above, the curable polymer composition may be varied for certain applications; however, the above exemplary composition is outstanding. Useful variations include, in general, the thermosetting (cross-linking) resins derived from monomers and/or polymers obtained by addition polymerization such as:

1. Unsaturated polyesters as described by "Unsaturated Polyesters: Structure and Properties", by Herman V. Boenig, Elsevier Publishing Company, New York, 1964, exemplified by epoxy, polyurethanes and polysulfides.
2. Synthetic rubbers based on butadiene, chloroprene and copolymers containing these monomeric constituents and as generally described in "Vinyl and Related Polymers", by Calvin E. Schildkneckt, John Wiley & Sons, New York, 1959, pp. 48 to 178.
3. Vinyl-type mixtures of monomers and polymers which give the "water-borax mixture" the suitable mechanical wet properties before polymerization and which contain at least 10% by weight based on the material of the total mixture containing polymerizable unsaturation of a multifunctional polymerizable cross-linking agent such as divinyl benzene, dialkyl phthalate, ethylene diacrylate and others well known to the art of cross-linked resins.

The polymerizable monomer may be varied and includes compounds such as those of the formula

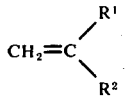

wherein, for example, $R^1$ is H, $CH_3$, $CH_2CH_2$—, phenyl, Cl— or —CN;
$R^2$ is H, —CN,

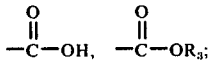

wherein $R^3$ is alkyl, cycloalkyl, or aryl.

Variations in insulation composition may be employed. For example, other neutron absorbers such as the water soluble cadmium salts including cadmium nitrate may be used. The amount of neutron absorbing nuclei may be varied depending on its absorption effectiveness. With sodium tetraborate, between about 0.5 to 1.5% by weight of the boron atom based on total insulation weight is preferred. Also, other antifreeze materials such as methanol, glycerol or various inorganic salts may find limited application in the present invention but are not preferred. As mentioned above, up to about 50% by weight based on total insulation weight of solid siliciferous material may be employed to fill the desired amount of insulation. This material includes many other materials besides vermiculite including other forms of lightweight mica. Lava, pumice and perlite are also useful. Up to about 35% based on total insulation weight of chopped glass fiber reinforcing may be employed. Such glass fiber is shown, for example, in the aforementioned patents, as well as U.S. Pat. Nos. 2,877,501 and 3,516,957, incorporated herein by reference. In this regard, the locations within the housing which can accommodate the filled insulation will depend to a large degree on the test stresses imparted thereto. Filling does tend to embrittle many plastic systems. For this reason, the fiber glass reinforcement offers an important solution.

The insulation components may vary in parts by weight based on 100 parts of resinous system between, for example, 50–150 parts water, 50–150 parts ethylene glycol, 0.5–10.0 parts peroxide catalyst, up to about 40 parts sodium tetraborate, and up to about 250 parts of siliciferous filler or glass fiber or mixtures thereof. A preferred range of insulation components in parts by weight, based on 100 parts of polymerizable resinous system, is 55–70 parts water, 55–75 parts ethylene glycol, 1.0–5.0 parts hydrogen peroxide, and 15–30 parts sodium tetraborate and 40–70 parts vermiculite.

A preferred adjunct to the insulation is a temperature resistant epoxy, alkyd, polyamide or the like sealing coating covering all exposed surfaces of the insulation 116 including block 124 and bolt clearances 122. This coating prevents loss of water from the insulation, particularly when the cover 18 is removed for any appreciable period of time. Water loss is also prevented by the use of a gasket of suitable elastomeric or latex material between rim 26 and cover 18. A particularly effective way of preventing water loss around bolts 38 is to weld a seal between the nuts 36 and ring 32, shorten bolts 38 and dead-end the threaded holes in nuts 36 to form threaded caps.

As mentioned previously, pressure relief holes 126 are plugged with epoxy or other suitable adhesive. This plugging seals in the water, the loss of which could otherwise be substantial since there should be at least about one 3/16-inch diameter hole per square foot of exterior surface area of the housing 12. These holes are essential in releasing the enormous pressures built up within the housing during the one-hour oil fire testing, during which the resin plugs in holes 126 are burned or forced out. The number of relief holes should not be excessive, however, since maintaining a pressurized steam blanket in the housing is an important aspect of the shielding of the pressure vessel and gamma shield assembly from the otherwise disastrous heat of the oil fire. Also, an excessive number of relief holes would allow air to enter the container during the heat test and actually burn the insulation, particularly those portions thereof which have become partially heat disintegrated.

Variations in structural materials of the container may also be used. For example, the wood spacers 110 and 44 and 46 may be of steel where extreme strength is needed, regardless of container weight, and aluminum could be used in certain instances.

The particular configuration shown for the housing is quite preferred but variations are possible. For example, the strengthening ribs 14, rather than being formed in the sheet metal, could constitute welded-on rolled bars similar to 24. Moreover, longitudinal stiffeners could be welded up the side of the housing to the ribs 14 to provide a very strong cage effect. The housing, rather than being two drums welded together, could be a single rolled and welded steel sheet, with, for example, longitudinally extending strengthening ribs formed therein. Also, the sealing rings 80 and 82 could be set into grooves in flange 52 rather than in the head 54. Moreover, the sealing rings could be of different cross-sectional shapes and several could be used to give a surer seal. At least two sealing rings are required, however, in order that the pressurized test gas can be fed there between.

A particularly effective container for plutonium solids and solutions is essentially as shown in FIG. 3 employing however, solid resinous material 116 (WEP) rather than vermiculite filled WEP, a considerably thicker (one inch) lead shield 104, steel spacers 110, a one quarter inch thick bottom plate 96 the diameter of which extends to adjacent the inside of housing 12, the positioning of bar band 28 such that the plane of plate 96 will be approximately at the middle of band 28, and the use of a slab of solid WEP at the bottom of the container housing in place of the wooden pieces 44 and 46. For assembling such container, the slab is poured first and then bottom plate 96 is nailed to it. Also in this container, inner wall 92 is a little shorter than outer wall 94 and is closed at the bottom by a one quarter inch thick stainless steel plate which, in the assembled container, is spaced from bottom plate 96, and lead shielding is provided in the space. The solid WEP is fiber glass reinforced and contains the ethylene glycol and borax.

Figure 6:
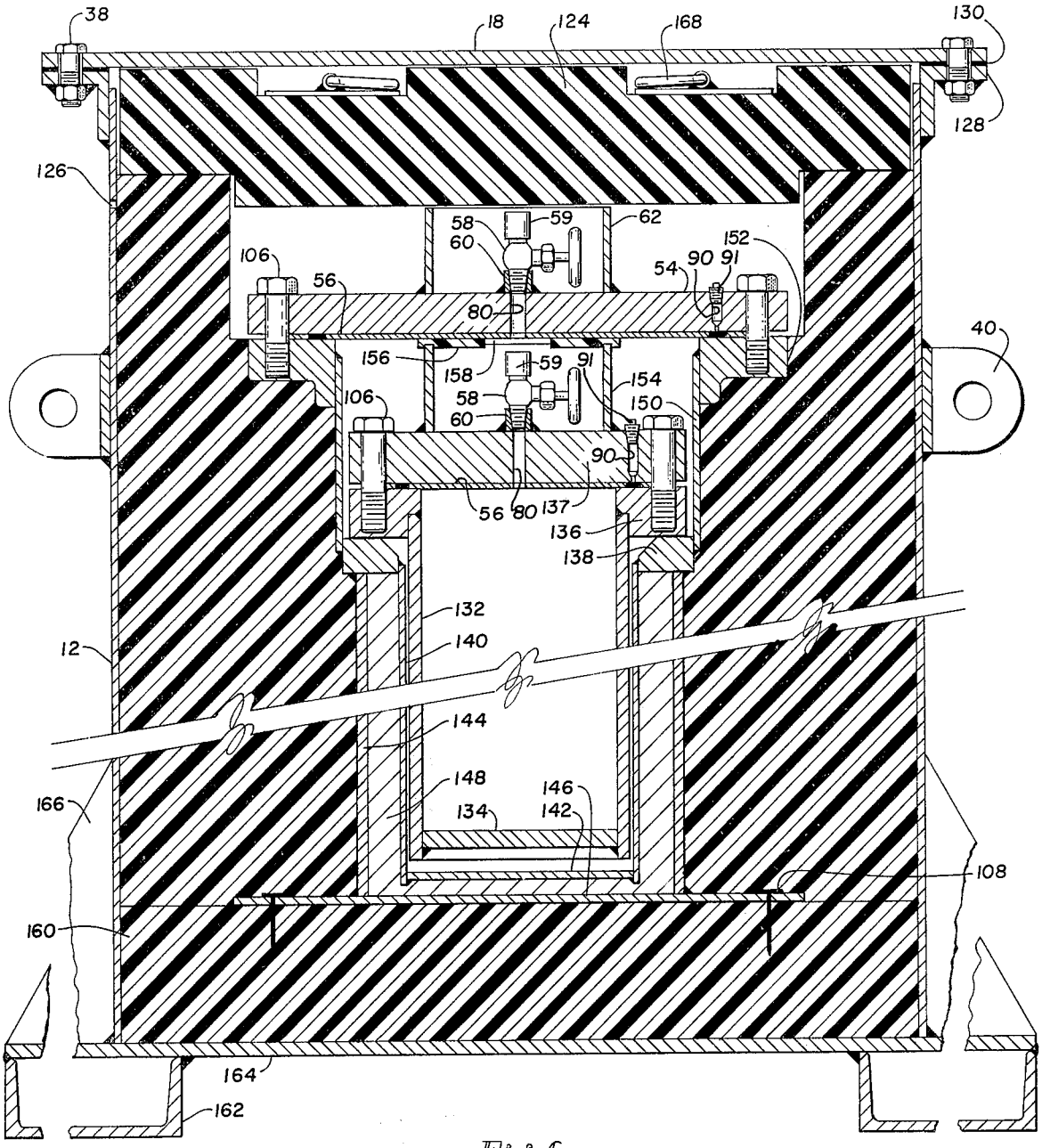
FIG. 6 is a cross-sectional view as in FIG. 3, showing the double containment version of the present container.

In FIG. 6 a double-containment version of the container for transporting plutonium solids is shown. The numbering corresponds to the equivalent parts of FIGS. 1–5. This container is much heavier than the others described herein and preferably 11 gauge steel for example is used for the housing 12. The cover 18 is thick steel which, in the embodiment shown is ⅜ inch thick, 28 inches in diameter, and secured by 20 equally spaced ⅝ inch cadmium or zinc plated hex head cap screws 38 to a heavy angle ring 128 welded around the top of housing 12. The seal between cover 18 and ring 128 is provided in this embodiment by a ⅛ inch thick by 2 inch wide neoprene strip gasket 130 of 40 to 50 Durometer attached with suitable adhesive thereto. In this embodiment, the pressure vessel comprises stainless steel pipe 132 welded at the bottom to stainless steel disc 134. The top of pipe 132 is welded to stainless steel socket flange 136. Blind flange 137 completes the assembly. The radiation shielding comprises ring 138, tubing 140 welded thereto, bottom disc 142 welded to the bottom of tubing 140, all of stainless steel, steel tubing 144 welded at the top to ring 138 and at the bottom to disc 146. Disc 146 is welded on last after molten lead 148 is poured into the inverted shield. The double containment aspect arises from the stainless steel pipe 150 welded to ring 138 and to the inside of stainless steel slip-on flange 152, and blind flange 54. The pressure vessel is contained with the container thus defined. In order for gasses which may lead past the pressure vessel seal to be released through the outermost valve 58, and the pressure thus dissipated throughout a larger volume, shroud 154 is spaced from the metal portion of outer seal ring 56 by two Viton A pads 156. This arrangement provides vent gaps 158 communicating with said outermost valve 58 through flange 54. Shroud 154, alternatively to or in conjunction with pads 156, may be provided with suitable apertures to provide the desired gas communication to outermost valve 58 and may be of a large diameter as desired. In this embodiment, the bolt holes in flanges 136 and 152 are threaded to eliminate the need for separate nuts. Also, disc 146 is secured in place to precast slab 160 by nails 108, thus eliminating members 44 and 46. Steel channels 162 welded to the bottom of plate 164 provide a convenient means for fork-truck handling, and gussets 166 provide strength and stability for the top-heavy container. List handles 168 are secured to plug 124 by any suitable means.

In this embodiment of FIG. 6, a typical uncured WEP formulation comprises in percent by weight, 33.0 to 39.0 and preferably 36.0 resin, 19.0 to 24.0 and preferably 21.9 water, 20.0 to 27.0 and preferably 23.3 ethylene glycol, 6.0 to 9.0 and preferably 7.9 borax (equivalent to 0.9 boron), 0.4 to 1.5 and preferably 0.9 hydrogen peroxide or the equivalent thereof of other peroxide curing agents, and 6.0 and 15.0 and preferably 10.0 chopped fiberglass roving. It is particularly noted that the positioning means between the housing and the pressure vessel and gamma shield assembly is the solid WEP, and wooden or steel members such as 110 are obviated.

The unusual construction of the FIG. 6 container may be expressed as a container for nuclear fuels comprising a metal housing, a pressure vessel and gamma shield assembly in said housing, positioning means extending between said housing and said assembly for spacing the same, insulation essentially filling the space between said assembly and housing and comprising water beads encapsulated in plastic, wherein the positioning means is the insulation and the pressure vessel is double containment comprising two generally tubular vessels, each of which has a closed bottom end and a flanged upper end, a closure head bolted to the flanged upper end and gas seal means between the head and flanged upper end, one of said vessels being nested within the other such that gas passageways are provided interconnecting the seal means of both vessels.

The invention has been described in detail with reference to certain preferred embodiments thereof, but it will be understood that variations and modifications can be effected within the spirit and scope of the invention.

We claim:

1. A container for nuclear materials comprising a metal housing, a pressure vessel and gamma shield assembly in said housing, positioning means extending between said housing and said assembly for spacing the same, and insulation essentially filling the space between said assembly and housing, said insulation comprising water beads encapsulated in plastic.

2. The container of claim 1 wherein a neutron absorber and antifreeze are dispersed in said water.

3. The container of claim 1 wherein said housing is in the general form of an elongated cylinder closed at the bottom and having a removable sheet metal cover, a first bar ring welded to said cover adjacent the periphery thereof, the upper end of said cylinder having a first bar band welded around the outside thereof, a second bar ring welded around the inside of said cylinder at said upper end such that said upper end of said cylinder is positioned between said second bar ring and said first bar band, said bar rings being provided with circumferentially spaced bolt receiving apertures.

4. The container of claim 3 wherein the weld of said second bar ring to the upper end of said container extends therethrough into said first bar band.

5. The container of claim 3 wherein nuts are welded to the underside of said second bar ring at said bolt receiving apertures.

6. The container of claim 3 wherein said housing is provided with outwardly projecting, formed, strengthening ribs.

7. The container of claim 2 wherein said insulation is mixed with up to about 50% by weight of solid siliciferous material based on total insulation weight.

8. The container of claim 2 wherein said insulation contains, in dispersed form, a total of up to about 35% by weight based on total weight of insulation, of one or more of the additives selected from vermiculite and chopped glass fiber.

9. The container of claim 1 wherein the pressure vessel comprises an elongated tube closed at one end and provided at its open end with a first flange welded to the periphery thereof, wherein the gamma shield comprises inner and outer spaced walls forming a double walled cylinder, a bottom plate welded to adjacent ends of said walls, a second flange welded to the periphery of the open end of said inner wall, said second flange having a leg projecting substantially normally downwardly from the flange face a distance between said inner and outer walls, a lead shield filling the space between said walls, said pressure vessel being positioned inside of said inner wall and slightly spaced therefrom with said first and second flanges in mating contact, a closure head positioned on said first flange, and bolt means clamping said flanges and head.

10. The container of claim 9 wherein said positioning means comprises metal ribs secured to and spaced around the periphery of said outer wall of said gamma shield and extending radially outwardly to adjacent the inside of said housing, the space between said ribs being substantially greater than the space which they occupy.

11. The container of claim 9 wherein concentric elastomeric rings are positioned between said closure head and said first flange, and conduit means is provided in said closure head adapted to communicate with the space between said rings.

12. The container of claim 9 wherein a seal is positioned between said closure head and said first flange and comprises a substantially flat member having at least a pair of concentric channels formed in each of its faces, first conduit means connecting the channels of each pair, an elastomeric seal positioned in each of said channels sealing said closure head against said first flange, second conduit means connecting each of said first conduit means, and third conduit means in said closure head adapted to connect with said first conduit means.

13. The container of claim 1 wherein the insulation is formed from a mix composition in parts by weight, based on 100 parts by weight of polymerizable resinous system, comprising 50–150 parts water, 50–150 parts ethylene glycol, 0.5–10.0 parts peroxide catalyst, and up to about 40 parts sodium tetraborate.

14. The container of claim 9 wherein the insulation is formed from a mix composition in parts by weight, based on 100 parts by weight of polymerizable resinous system, comprising 55–70 parts water, 55–75 parts ethylene glycol, 1.0–5.0 parts peroxide catalyst, and 15–30 parts sodium tetraborate.

15. The container of claim 13 wherein at least a portion of the insulation contains substantially distributed therein up to about 250 parts by weight of total of one or more of the additives selected from solid siliciferous material and chopped glass fiber reinforcing.

16. The container of claim 13 wherein the insulation in approximately the lower three-fourths of the container contains distributed therein up to about 250 parts by weight of vermiculite.

17. The container of claim 9 wherein the insulation is formed from a mix composition in parts by weight consisting of about 40 parts polymerizable resinous system, about 24.3 parts water, about 25.9 parts ethylene glycol, about 0.5–2.0 parts hydrogen peroxide, and about 8.8 parts sodium tetraborate.

18. The container of claim 13 wherein the polymerizable resinous system comprises, in parts by weight, from about 18–22 parts isophthalic acid, 3–8 parts maleic anhydride, 45–55 parts styrene, 3–8 parts propylene glycol, and 10–20 parts diethylene glycol.

19. The container of claim 1 wherein the positioning means is the insulation, and the pressure vessel is double containment comprising two generally tubular vessels, each of which has a closed bottom end and a flanged upper end, a closure head bolted to the flanged upper end and gas seal means between the head and flanged upper end, one of said vessels being nested within the other such that gas passageways are provided interconnecting the seal means of both vessels.

20. The container of claim 19 wherein the components of the uncured resin system comprise in parts by weight 33.0 to 39.0 resin, 19.0 to 24.0 water, 20.0 to 27.0 ethylene glycol, 6.0 to 9.0 borax, 0.4 to 1.5 peroxide curing agent, and 6.0 to 15.0 chopped fiberglass roving reinforcement.

21. A double containment pressure vessel for use in a container for nuclear materials, said vessel comprising two generally tubular vessels, each of which has a closed bottom end and a flanged upper end, a closure head bolted to each flanged upper end and gas seal means between each closure head and associated flanged upper end, one of said vessels being nested within the other such that gas passageways are provided interconnecting the seal means of both vessels.

22. The vessel of claim 21 wherein gas passage means is provided through each closure head, and valve means is provided in each of said passage means to regulate gas flow therethrough.

23. The vessel of claim 21 wherein a port is provided in each of said closure heads communicating with the associated seal means, said ports being adapted for connection to a device for testing said seal means.

* * * * *